United States Patent [19]

Fushida et al.

[11] 4,123,271

[45] Oct. 31, 1978

[54] ALKALI METAL DICHROMATE AS MEMORY RESISTANCE IMPROVER FOR ZINC OXIDE PHOTOCONDUCTORS IN ELECTROSTATIC PHOTOGRAPHY

[75] Inventors: Akira Fushida, Suita; Hiroichi Morikawa, Osaka; Toshihiro Shinsho, Katano; Takaaki Miyazaki, Daito; Tatsuo Aizawa, Osaka, all of Japan

[73] Assignee: Mita Industrial Company, Limited, Osaka, Japan

[21] Appl. No.: 744,450

[22] Filed: Nov. 23, 1976

Related U.S. Application Data

[63] Continuation-in-part of Ser. No. 435,576, Jan. 22, 1974, abandoned.

[51] Int. Cl.[2] ..... G03G 7/00

[52] U.S. Cl. ..... 96/1.8; 96/1.5 R; 96/1.6; 96/1.7

[58] Field of Search ..... 96/1.8, 1.5, 1.7

[56] References Cited

U.S. PATENT DOCUMENTS

| | | | |
|---|---|---|---|
| 2,331,444 | 10/1943 | Wainer | 96/1.5 UX |
| 2,748,288 | 5/1956 | Sanlnier | 96/1.5 X |
| 2,955,938 | 10/1960 | Steinhilper | 96/1.5 |
| 2,993,787 | 7/1961 | Sugarman | 96/1.8 |
| 3,037,861 | 6/1962 | Hoegl et al. | 96/1.5 |
| 3,128,204 | 4/1964 | Schaum et al. | 96/1.5 UX |
| 3,159,483 | 12/1964 | Behmenburg et al. | 96/1.5 |
| 3,197,307 | 7/1965 | Blake et al. | 96/1.8 |
| 3,231,375 | 1/1966 | Sciambi | 96/1.8 |
| 3,287,114 | 11/1966 | Hoegl | 96/1.5 |
| 3,352,669 | 11/1967 | Murphy | 96/1.5 |
| 3,379,527 | 4/1968 | Carrsin et al. | 96/1.5 |
| 3,380,823 | 4/1968 | Gold | 96/1.8 |
| 3,454,415 | 7/1969 | Bonjour | 96/1.8 X |
| 3,464,820 | 9/1969 | Michalchik | 96/1.8 |
| 3,554,125 | 1/1971 | Van Dorn et al. | 96/1.5 X |
| 3,573,906 | 4/1971 | Goffe | 96/1.8 |
| 3,615,405 | 10/1971 | Shebanow | 96/1.5 |
| 3,642,480 | 2/1972 | Vrancken | 96/1.5 X |
| 3,663,225 | 5/1972 | McLeod | 96/1.8 X |
| 3,672,888 | 6/1972 | Hasegawa et al. | 96/1.8 |
| 3,674,483 | 7/1972 | Vrancken et al. | 96/1.5 X |
| 3,700,447 | 10/1972 | Ravich et al. | 96/1.5 |
| 3,930,854 | 1/1976 | Jcnes | 96/1.8 |

FOREIGN PATENT DOCUMENTS

| | | | |
|---|---|---|---|
| 41-15,469 | 8/1966 | Japan | 96/1.8 |
| 42-2,995 | 2/1967 | Japan | 96/1.8 |
| 43-7,593 | 3/1968 | Japan | 96/1.5 |

OTHER PUBLICATIONS

Hayashi et al., "Sensitization in the Photoconductance of Poly-N-vinylcabazole", *Bulletin of the Chemical Society of Japan*, vol. 39, No. 8, 1966, pp. 1660–1670.

Nathan et al., *Organic Chemistry Made Simple*, 1962, pp. 152–153.

Vozmilova et al., *Chemical Abstracts*, vol. 69, 1968, p. 81690z.

Hopkins & Bailar, *General Chemistry for Colleges*, 5th Ed., 1956, pp. 609–614.

*Hackh's Chemical Dictionary*, 3rd Ed., 1944, pp. 676–677.

Cotton & Wilkinson, *Advanced Inorganic Chemistry*, 1966, pp. 818–819, 828–829, 834–835, and 839–840.

Boldyrev et al., *Chemical Abstracts*, vol. 70, 1969, p. 15306.

*Primary Examiner*—John T. Goolkasian

*Attorney, Agent, or Firm*—Wenderoth, Link & Ponack

[57] ABSTRACT

A process for preparing a photosensitive material for electrostatic photography having an improved memory resistance, which comprises a photoconductive layer on an electrically conductive substrate, the photoconductive layer comprising (1) a finely divided inorganic photoconductor, (2) 5 to 50 parts by weight, per 100 parts by weight of the photoconductor of an electrically insulating organic synthetic resin binder having a specific resistance of at least $10^{14}$ ohm-cm, and (3) 0.001 to 1 % by weight, based on the photoconductor, of at least one photo-memory erasing compound selected from alkali metal dichromates, which process comprises forming the photoconductive layer by applying a coating composition to the electrically conductive substrate at a coating weight of 5 to 50 g/m$^2$, the coating composition comprising the photo-memory erasing compound, the photoconductor, the resin binder, an aromatic solvent in which the resin binder is dissolved or dispersed, an a polar solvent for the photo-memory erasing compound, the polar solvent being soluble in the aromatic solvent and being selected such that the photo-memory erasing compound is soluble in said polar solvent.

2 Claims, 3 Drawing Figures

Figure 1:
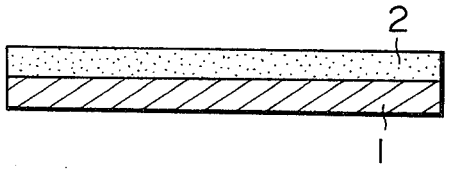

ALKALI METAL DICHROMATE AS MEMORY RESISTANCE IMPROVER FOR ZINC OXIDE PHOTOCONDUCTORS IN ELECTROSTATIC PHOTOGRAPHY

This application is a continuation-in-part application of Ser. No. 435,576 filed on Jan. 22, 1974 which has now been abandoned.

This invention relates to a process for preparing a photosensitive material for electrostatic photography.

Photosensitive materials for electrostatic photography usually comprise a photoconductive layer composed of a photoconductor and an electrically insulating binder on an electrically conductive substrate composed of a conductive material or of a paper base having a conductive layer formed thereon. In the electrostatic photography process, an electrostatic latent image is formed by utilizing the photoconductivity of the photoconductive layer. For example, an electrostatic image corresponding to the image of an original is formed on the photoconductive layer by electrostatically charging the surface of the photoconductive layer with a charge of a specific polarity and image-exposing the charged photoconductive layer. The so-formed electrostatic latent image is developed with toner particles of a specific polarity directly or after transfer of the latent image onto a transfer sheet, to form a visible image.

In the electrostatic photography process, the memory effect of the photoconductive layer is a serious problem. More specifically, although the photoconductive layer is required to be conductive only when it is irradiated with light, when the effect of the pre-exposure (exposures before charging) is left in the photoconductive layer, it is slightly conductive even in the dark and therefore, the static charge escapes from the surface of the photosensitive layer (photoconductive layer) at the charging step, with the result that the initial potential on the surface of the photoconductive layer is reduced and a clear image of high contrast cannot be obtained. Photoconductors heretofore used for photosensitive materials for electrostatic photography have a memory effect, and in a compact copying machine for office use in which photosensitive papers are manually inserted in the dark or in a transfer-type copying machine or printing machine in which one photosensitive plate for electrostatic photography is repeatedly used in the charging and exposing steps, the memory effect of the photoconductive layer results in serious troubles.

It has been proposed to treat photoconductors or photoconductive layers with various modifiers in order to improve memory resistance but incorporation of such modifiers usually results in a reduction of the initial potential or dark decay residual ratio or in a reduction in sensitivity.

We found that when in a coating composition for formation of a photoconductive layer comprising an inorganic photo-conductor, a resin binder and an aromatic solvent for dissolving and dispersing the resin binder, an alkali metal chromate in an amount of 0.001 to 1% by weight, especially 0.001 to 0.01% by weight, based on the photo-conductor and a polar solvent soluble in said aromatic solvent are incorporated in combination and when the resulting composition is coated on an electrically conductive substrate, the memory resistance of the resulting conductive layer can be highly improved while maintaining the initial potential or dark decay residual ratio of the photoconductive layer at a high level when the photoconductive layer is charged. This improvement in the memory effect can be accomplished without reducing the sensitivity of the photoconductive layer.

The invention provides a process for preparing a photosensitive material for electrostatic photography comprising a photoconductive layer on an electrically conductive substrate, the photoconductive layer comprising (1) a finely divided inorganic photoconductor, (2) 5 to 50 parts by weight, per 100 parts by weight of the photoconductor of an electrically insulating organic synthetic resin binder having a specific resistance of at least $10^{14}$ ohm-cm, and (3) 0.001 to 1% by weight, based on the photoconductor, of at least one photo-memory erasing compound selected from alkali metal dichromates, which process comprises forming the photoconductive layer by applying a coating composition to the electrically conductive substrate at a coating weight of 5 to 50 g/m$^2$, the coating composition comprising the photo-memory erasing compound, the photoconductor, the resin binder, an aromatic solvent in which the resin binder is dissolved or dispersed, and a polar solvent for the photo-memory erasing compound, the polar solvent being soluble in the aromatic solvent and being selected such that the photo-memory erasing compound is soluble in said polar solvent.

The photoconductor is a finely divided inorganic photoconductor such as photoconductive zinc oxide, titanium oxide, selenium, cadmium selenide, cadmium sulfide, selenium sulfide, lead sulfide and lead selenide.

The electrically insulating organic synthetic resin binder has a specific resistance of at least $10^{14}$ ohm-cm. Suitable binders are, for example, polyester resins, acrylic resins, alkyd resins, polystyrene, styrene copolymers, vinyl acetate resins, polyvinyl acetal resins, epoxy resins and melamine resins. An especially high improvement in the memory resistance can be attained when the photoconductive layer comprises zinc oxide as photoconductor and a polyester resin, an acrylic resin or an alkyd resin as binder. The polyester, acrylic and alkyd resins give photosensitive layers having a high memory effect for unknown reasons, probably because of such factors as the polymerization catalysts used or polymerization conditions.

If the photoconductor has no sensitivity to rays of the visible region, the photoconductor can be sensitized using one or more sensitizing color such as Rose Bengale (C.I. 45440), Eosine (C.I. 45380), Fluoresceine (C.I. 45350), Acid Green 25 (C.I. 61570), Acridine Orange (C.I. 46005) and Bromophenol Blue.

The electrically insulating binder is used in an amount of 5 to 50 parts by weight, preferably 10 to 30 parts by weight, per 100 parts by weight of the photoconductor.

The coating composition is applied to the substrate at the coating weight of 5 to 50 g/m$^2$, preferably 10 to 40 g/m$^2$, especially preferably 20 to 30 g/m$^2$.

The photo-memory erasing compound is an alkali metal, especially sodium dichromate which is readily available and gives a high memory resistance.

The amount of the photo-memory erasing compound used is from 0.001 to 1% by weight, prefrrably 0.001 to 0.01% by weight (hereinafter "%" and "parts" are on a weight basis unless otherwise indicated) based on the photoconductor.

The photo-memory erasing compound should be soluble in the polar solvent (such as methanol and ethanol) and the polar solvent should be soluble in the aromatic solvent (such as toluene and xylene). Preferably the soluble photo-memory erasing compound is added in the form of a solution in the polar solvent to a coating composition comprising the photoconductor, binder and aromatic solvent. This embodiment is especially advantageous because the memory resistance can be highly improved by addition of a very small amount of the photo-memory erasing compound.

In the case of ordinary photosensitive papers for electrostatic photography, a conductive barrier layer (undercoat) is usually applied to that surface of the paper substrate on which the photoconductive layer is to be formed, in order to render the paper substrate conductive and to prevent a photoconductive layer-forming coating composition from permeating into the paper substrate. For instance, a conductive resin binder or a combination of a conductor and a resin binder is generally used together with a sticking-preventive agent composed of an inorganic solid substance for formation of such undercoat.

Figure 2:
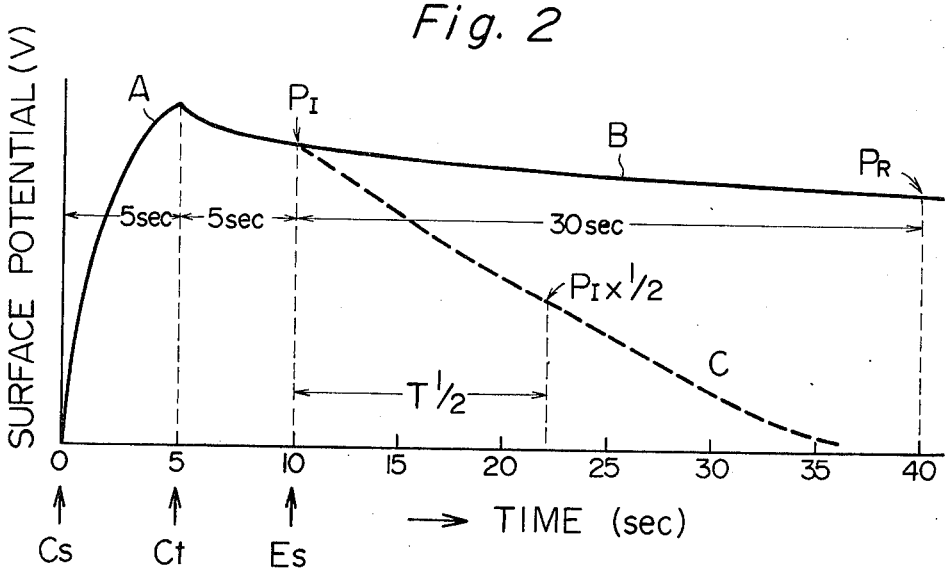
Figure 3:
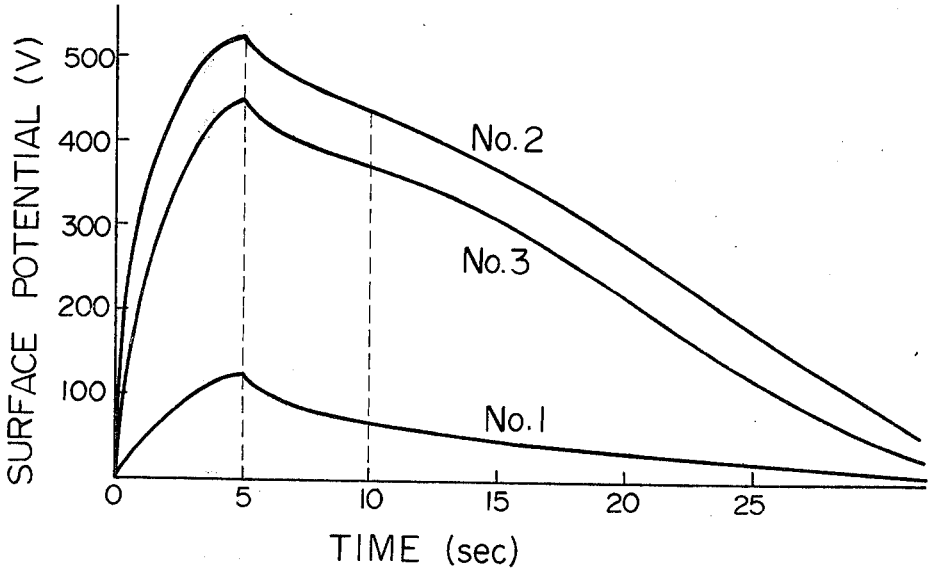

The invention will now be illustrated by reference to the accompanying drawings, in which:

FIG. 1 is a diagram showing a section through a photosensitive material for electrostatic photography prepared in accordance with the invention;

FIG. 2 is a curve showing the relation between the surface potential and the lapse of time after initiation of charging of the photosensitive material, together with other electric properties; and FIG. 3 shows surface potential curves of photosensitive materials for electrostatic photography according to this invention (curves Nos. 2 and 3) and a comparative photosensitive material for electrostatic photography (curve No. 1).

In FIG. 1 the photosensitive material is composed of a conductive substrate 1 and a photoconductive layer 2 formed on the substrate. As the conductive substrate 1 there can be used, for example, foils and sheets of such metals as copper, aluminum and tin-plate, conductive resin films, and papers and non-woven fabrics. The conductive layer 2 contains the photoconductor dispersed in the electrically insulating binder.

A photosensitive material for electrostatic photography prepared in accordance with the invention is one wherein, even when the photosensitive layer is strongly irradiated for a long time before the electrostatic copying operation, the memory is extinguished in a very short time, and at the charging step of the electrostatic copying process either the initial potential or the dark decay residual ratio can be maintained at a high level. Further, at the image exposing step, the sensitivity can be maintained at a very high level. these excellent effects attained in accordance with this invention will readily be understood from the following experimental results.

EXAMPLE 1

In this Example, the improvement of the memory resistance by a photo-memory erasing compound was evaluated by comparing samples containing a photo-memory erasing compound with samples free of such a compound.

The following 3 samples of coating compositions were prepared. Each coating composition was dispersed for 15 minutes by means of an ultrasonic vibrator, and the dispersed composition was applied to the coated surface of a single-art-coated paper by means of a rod bar. Then, the coated paper was allowed to stand for 20 hours in a moisture-conditioned box in which the relative humidity was maintained at 40%. Then the so-treated coated paper was used as a test sample.

Sample No. 1 (free of chromium compound)

| | |
|---|---|
| zinc oxide (Sazex No. 4000 manufactured by Sakai Kagaku Kogyo Kabushiki Kaisha) | 100 g |
| Polyester resin (Atlac 382 A manufactured by Kao Atlas Kabushiki Kaisha) | 40 g |
| Rose Bengale (C.I. 45440) (solution in 15 ml of alcohol) | 30 mg |
| toluene | 90 g |

Sample No. 2 (containing sodium dichromate)

This sample was prepared by adding a solution of 5 mg of sodium dichromate (product of Yoneyama Yakuhin Kogyo Kabushiki Kaisha) in 5 ml of methanol to Sample No. 1.

Sample No. 3 (containing potassium dichromate)

This sample was prepared by adding 300 mg of potassium dichromate (product of Yoneyama Yakuhin Kogyo Kaisha) in 10 ml of methanol to Sample No. 1.

Each sample was allowed to stand for 60 seconds under irradiation of a fluorescent lamp of 500 luxes and the charging characteristics were immediately determined by means of a electrostatic paper analyzer Model SP-428 manufactured by Kawaguchi Denki Seisakusho. The applied voltage was −5 KV and a tungsten lamp of 10 luxes was used as a light exposure source for determination of light decay. Results are shown in Table 1.

Table 1

| Sample No. | Initial Potential (V) | Dark Decay Residual Ratio (%) | Light Half Decay Time (sec) |
|---|---|---|---|
| 1 | 71 | 93.0 | 16.8 |
| 2 | 445 | 91.8 | 13.0 |
| 3 | 375 | 92.7 | 11.9 |

Electric properties shown in Table 1 were determined by the following methods. In the curve of FIG. 2 showing the relation between the surface potential V of the photosensitive layer and the lapse of time from initiation of charging, the charging is initiated Cs at the origin O, and with the lapse of time the surface potential increases as shown by portion A of the curve. After 5 seconds have passed, the charging is completed Ct. The dark decay occurs in the surface potential of the photosensitive layer as shown by portion B of the curve. When 5 seconds have passed from the charging completion point Ct, the light exposure is started Es. With the lapse of the light exposure time, the light decay occurs in the surface potential as shown by portion C of the curve.

The initial potential $P_I$ is defined as a surface potential observed when the photosensitive layer is charged for 5 seconds and then allowed to stand still in the dark for 5 seconds (to cause dark decay).

The dark decay residual ratio (%) is represented by the following formula:

$$\text{dark decay residual ratio (\%)} = (P_R/P_I) \times 100$$

wherein $P_R$ is the surface potential (residual potential) observed when the photosensitive layer is charged for 5 seconds and allowed to stand for 35 seconds in the dark (to cause dark decay) and $P_I$ indicates the initial potential.

The light half decay time ($T_{1/2}$, sec) is a time expressed in seconds required for the surface potential to be reduced to ½ of the initial potential $P_I$ when the photosensitive layer is charged for 5 seconds, allowed to stand for 5 seconds in the dark and then irradiated by a tungsten lamp of 10 luxes to cause light decay. A smaller value of the light half decay time indicates a higher sensitivity.

Surface potential curves illustrating light decay properties for each of the foregoing test samples are shown in FIG. 3.

In order to evaluate the memory resistance of these samples, they were allowed to stand for a certain period of time under irradiation of a fluorescent lamp of 500 luxes, and immediately subjected to a copying operation using a copying machine (Copystar Model A-2 manufactured by Mita Kogyo Kabushiki Kaisha). In the case of sample No. 1, an image was not obtained when the above previous light exposure was conducted for 10 seconds.

In the case of sample No. 2, even when it was allowed to stand for more than 120 seconds under irradiation of the above fluorescent lamp, an image as clear as an image obtained by employing a sample stored in the dark could be obtained.

In the case of sample No. 3, when it was allowed to stand for a time not exceeding 90 seconds under irradiation of the above fluorescent lamp, an image as clear as an image obtained by employing a sample stored in the dark could be obtained.

From the foregoing experimental results it can be seen:

In samples free of a photo-memory erasing compound, the effect by the previous light exposure (memory effect) is very high, and the initial potential is extremely low at the charging step. Such photosensitive paper cannot be used for a copying machine in which paper feeding is conducted in the light, though it can be used for a copying machine in which a photosensitive paper is fed in the dark. In contrast, in the case of a photosensitive paper prepared in accordance with the invention, even when it is exposed under ordinary illumination conditions for a long time, either the initial surface potential $P_I$ or the dark decay residual ratio (%) can be maintained at a high level, and at the same time the sensitivity is good. Accordingly, a photosensitive paper prepared in accordance with this invention can be effectively used even for a copying machine in which paper feeding is conducted in the light.

A characteristic feature of the photosensitive material for electrostatic photography prepared in accordance with this invention is that an electrostatic latent image of either negative or positive polarity can be freely formed. When the surface of the photosensitive layer of the photosensitive material is negatively charged and then the image exposure is conducted, an electrostatic latent image of negative polarity can be obtained, and when the photosensitive layer surface is positively charged, an electrostatic latent image of positive polarity can be formed. Therefore, according to this invention it is possible to obtain either a positive image or a negative image using the same developer merely by changing the charge polarity at the charging step.

That the photosensitive layer can be charged not only negatively but also positively will readily be understood from the results of the following Example 2.

EXAMPLE 2

A photosensitive layer prepared by the process of this invention and a conventional photosensitive layer were compared with respect to the electric characteristics obtained when they were positively charged.

Each test sample was prepared in the following manner:

The coating composition indicated below was dispersed for 10 minutes by means of a ultrasonic vibrator, and the dispersed composition was coated on an art paper in an amount of 25 g/m$^2$ by means of a rod bar, and the coated paper was stored for 24 hours in a moisture-conditioned chamber maintained at a relative humidity of 40%.

Sample No. 4 (comparative sample)

| | |
|---|---|
| zinc oxide (Sazex No. 4000 manufactured by Sakai Kagaku Kogyo Kabushiki Kaisha) | 100 g |
| vinyl acetate resin (Gosenil M50-Z4 manufactured by Nippon Gosei Kagaku Kogyo Kabushiki Kaisha, solid content=50 %) | 40 g |
| sensitizing color (0.2 % solution of Bromophenol Blue in methanol) | 7.5 ml |
| toluene | 100 g |

Sample No. 5 (comparative sample)

| | |
|---|---|
| zinc oxide (Sazex No. 4000 manufactured by Sakai Kagaku Kogyo Kabushiki Kaisha) | 100 g |
| vinyl chloride-vinyl acetate copolymer resin (Denkalac No. 61 manufactured by Denki Kagaku Kogyo Kabushiki Kaisha, solid content=45 %) | 45 g |
| sensitizing color (0.2 % solution of Bromophenol Blue in methanol) | 7.5 ml |
| toluene | 100 g |

Sample No. 6 (sample of this invention)

This sample was prepared by adding 10 mg of sodium dichromate in 5 ml of methanol to Sample No. 4.

Each test sample was irradiated under a fluorescent lamp of 3000 luxes, and immediately, the charge characteristics were determined by employing an electrostatic paper analyzer Model SP-428 manufactured by Kawaguchi Denki Seisakusho. The applied voltage was +5 KV. Results are shown in Table 2.

Table 2

| Sample No. | initial potential (V) | dark decay residual ratio (%) | initial potential (V) | dark decay residual ratio (%) |
|---|---|---|---|---|
| 4 | 445 | 64.0 | 180 | 38.9 |
| 5 | 435 | 68.0 | 220 | 81.8 |
| 6 | 750 | 70.1 | 640 | 64.0 |

The values shown in Table 2 were determined by the same methods as described in Example 1.

By virtue of the foregoing characteristic properties, the photosensitive material for electrostatic photography prepared according to this invention can be effectively and conveniently used for formation of an electrostatic photocopying paper (electrofax paper) for a copying machine for office use, a photosensitive plate or master sheet for an electrostatic copying machine of the image-transfer or static image-transfer type, or an original plate for an electrostatic printing machine.

As is apparent to those skilled in the art, the photosensitive material of this invention includes various modifications. For instance, a multi-layer photosensitive material comprising a plurality of photoconductive layers or another multi-layer photosensitive material including a photoconductive layer sandwiched between a conductive layer and an electrically insulating layer can be formed with use of the process of this invention.

EXAMPLE 3

With respect to photosensitive plates for a plain paper copier including a zinc oxide photoconductor, the effect of addition of sodium dichromate was examined as regards the electric properties at the repeated charging-exposure operation and the influence of the previous exposure.

Each test sample was prepared by the following method.

The coating composition indicated below was dispersed for about 10 minutes, and the dispersed composition was coated in an amount of about 20 g/m$^2$ (dry base) uniformly on an aluminum sheet having a thickness of 50$\mu$. Then the coated sheet was dried. In the case of samples Nos. 14 and 15, a 8% solution of an ethylcellulose resin (Ethocel 10CPS manufactured by Dow Chemical Co.) in methanol was uniformly overcoated and dried on the surface of the sample to form a protective layer. Each of the so-prepared samples was allowed to stand still for about 20 hours in a dark moisture-conditioned box maintained at a relative humidity of 40%, and then it was tested.

Sample No. 7 (comparative sample)

| | |
|---|---|
| zinc oxide (Sazex No. 4000 manufactured by Sakai Kagaku Kogyo Kabushiki Kaisha) | 100 g |
| toluene | 80 g |
| Bromophenol Blue (1.0 % methanol solution) | 5 ml |
| phenol-modified alkyd resin (Beckosol 1341 manufactured by Dainippon Ink Kagaku Kogyo Kabushiki Kaisha, solid content=60 %) | 40 g |

Sample No. 8 (sample of this invention)

This sample was prepared by adding 1 ml of a 0.1% solution of sodium dichromate in methanol to Sample No. 7.

Sample No. 9 (comparative sample)

| | |
|---|---|
| zinc oxide (Sox-500 manufactured by Siedo Kagaku Kogyo Kabushiki Kaisha) | 100 g |
| toluene | 100 g |
| Bromophenol Blue (1.0 % methanol solution) | 5 ml |
| polyester resin (XPL 2005 manufactured by Kao Soap Kabushiki Kaisha, solid content=50 %) | 40 g |

Sample No. 10 (sample of this invention)

This sample was prepared by adding 1 ml of a 0.1% solution of sodium dichromate in methanol to the above sample No. 9.

Sample No. 11 (comparative sample)

| | |
|---|---|
| zinc oxide (Sazex No. 4000 manufactured by Sakai Kagaku Kogyo Kabushiki Kaisha) | 100 g |
| acrylic resin (Dianar LR472 manufactured by Mitsubishi Rayon Kabushiki Kaisha, solid content=40 %) | 50 g |
| toluene | 100 g |
| Rose Bengale (1.0 % methanol solution) | 5 ml |

Sample No. 12 (sample of this invention)

This sample was prepared by adding 1 ml of a 0.1% solution of sodium dichromate in methanol to the above sample No. 11.

In the case of ordinary photosensitive plates for a plain paper copier comprising a zinc oxide photoconductor, when charging is conducted repeatedly, it frequently happens that stable charge characteristics cannot be obtained. Further, if the memory resistance is reduced on placing the photosensitive plate in a copying machine, the first several copies are unstable. Therefore, in this experiment the comparison was made with respect to the changes of the charge-up ratio and initial potential observed at the repeated charging-exposure operation and the influence of the previous exposure on the charge-up ratio.

The repeated charging-exposure test was conducted according to the dynamic method by employing an electrostatic paper analyzer Model SP-428 manufactured by Kawaguchi Denki Seisakusho under the following conditions:

applied voltage: −5 KV
charging time: 10 seconds
dark decay time: 5 seconds
light decay: 10 seconds under 100 luxes The charging-exposure operation was repeated 48 times continuously, and then the sample was left set for 1 minute in the tester kept dark and the charge-up ratio and surface potential were measured in the same manner.

In Table 3, the value of the charge-up ratio (%) was calculated by dividing the surface potential observed 2.5 seconds after initiation of application of −5 KV by the surface potential observed 10 seconds after initiation of application of −5 KV. The value of repetition frequency 49 in Table 3 was one determined with respect to the sample which was allowed to stand in the above-mentioned manner after repeating the charging-exposure operation 48 times. The initial surface potential shown in Table 3 was one obtained just after conducting the charging for 10 seconds under −5 KV.

The previous exposure test was conducted in the following manner.

Each test sample was allowed to stand under illumination of a fluorescent lamp of 3000 luxes for 30 seconds, and then it was charged under −5 KV. The surface potential was determined when the charging was continued for 2.5 or 5 seconds, and the charge-up ratio was calculated in the same manner as mentioned above based on the surface potential observed when the charging was continued for 10 seconds.

Table 3

| Sample No. | Frequency No. | Charge-Up Ratio (%) 1 | 12 | 24 | 36 | 48 | 49 | Initial Surface Potential (V) 1 | 12 | 24 | 36 | 48 | 49 | Influence of Previous Exposure (Charge-up Ratio,%) 2.5 seconds | 5 seconds |
|---|---|---|---|---|---|---|---|---|---|---|---|---|---|---|---|
| 7 | | 78.4 | 41.7 | 31.8 | 31.7 | 31.8 | 84.1 | 510 | 300 | 280 | 280 | 290 | 490 | 0 | 33.3 |
| 8 | | 82.9 | 41.5 | 35.3 | 34.5 | 35.1 | 89.7 | 555 | 530 | 510 | 520 | 525 | 540 | 88.4 | 95.3 |
| 9 | | 97.8 | 53.7 | 46.9 | 41.5 | 38.1 | 71.1 | 460 | 410 | 405 | 410 | 425 | 450 | 2.5 | 55.0 |
| 10 | | 100.0 | 93.4 | 91.7 | 88.3 | 88.5 | 95.0 | 480 | 480 | 470 | 470 | 475 | 480 | 92.3 | 98.5 |
| 11 | | 76.5 | 41.0 | 42.3 | 41.3 | 43.6 | 62.0 | 405 | 390 | 380 | 390 | 380 | 410 | 2.8 | 48.6 |
| 12 | | 76.5 | 72.7 | 68.2 | 69.0 | 69.8 | 73.0 | 450 | 440 | 440 | 420 | 440 | 445 | 72.2 | 100.0 |

From the results shown in Table 3 it can be seen:

In the repeated charging-exposure operation, the charge-up ratio is higher with the samples containing sodium dichromate than in samples free of sodium dichromate. In short, charging can be performed at a higher speed in the photosensitive material of this invention than in the conventional material. When the difference between the charge-up ratio obtained at the start of the repeated charge-exposure operation and the charge-up ratio obtained when the cycle of charging-exposure is repeated several times is great, a copy obtained at the start of operation differs greatly from a copy obtained when the operation is repeated several times continuously, with respect to the image density and image condition. The fact that the above difference of the charge-up ratio is very small in the photosensitive material of this invention means that copies of good quality can be obtained stably. Further, when the photo-memory erasing compound is incorporated into a photoconductive layer, the recovery of the photoconductive layer after the repeated continuous copying operation is much higher than in the case where no photo-memory erasing compound is added.

Also with respect to the surface potential, the difference between the initial potential and the surface potential observed after the repeated continuous copying operation is small. In short, the copy density is stable when the photo-memory erasing compound is used. When charging is continued for 10 seconds, even comparative samples 9 and 11 free of the photo-memory erasing compound are sufficiently charged and a saturated potential is attainable (see data of the initial potential on Table 3). However, if the charging time is shortened, the initial potential is much lowered, which is apparent from the data of the charge-up ratio on Table 3. In conclusion, when a photo-memory erasing compound such as sodium dichromate is incorporated in the photoconductive layer, the copying rate can be greatly enhanced and copies of good image conditions can be obtained stably.

EXAMPLE 4

In this Example, the influences of the amount added of sodium dichromate on the light decay and dark decay were examined.

Photosensitive compositions were prepared by adding sodium dichromate in a form of 0.1% solution in methanol to a photosensitive composition having a recipe indicated below. The amount added of sodium dichromate was adjusted to 5 mg, 10 mg or 0 mg per 100 g of zinc oxide (ZnO). The composition was then dispersed for 15 minutes by a ultrasonic dispersing machine, coated on a rigid aluminum sheet (having a thickness of 50$\mu$) by a rod bar and dried. The resulting coated aluminum sheet was stored in a box maintained at a relative humidity (RM) of 40% or 90% for 20 hours.

Recipe of Photosensitive Composition:

| | |
|---|---|
| Zinc oxide (SOX-500 manufactured by Seido Kagaku Kogyo Kabushiki Kaisha) | 100 g |
| Toluene | 80 g |
| Rose Bengale (1 % solution in methanol) | 3 ml |
| Acrylic resin (Acrylic A405 manufactured by Dai-Nippon Ink Kabushiki Kaisha; solid Content= content= 50 %) | 40 g |

The light decay and dark decay were measured in the same manner as described in Example 1 to obtain results shown in Table 4. In this Example, the previous exposure was not conducted.

Table 4

| Amount Added of Sodium Dichromate | Stored at RH of 40% Initial Potential (V) | Dark Decay Residual Ratio (%) | Light Half Decay Time (sec) | Stored at RH of 90% Initial Potential (V) | Dark Decay Residual Ratio (%) | Light Half Decay Time (sec) |
|---|---|---|---|---|---|---|
| not added | 440 | 93.2 | 7.3 | 410 | 78.0 | 6.8 |
| 5 mg | 405 | 88.9 | 10.5 | 400 | 75.0 | 9.5 |
| 10 mg | 445 | 76.4 | 14.2 | 450 | 66.7 | 17.8 |

As will be apparent from the above results, when the previous exposure is not conducted, the dark decay residual ratio and light half decay time characteristics are worsened as the amount added of sodium dichromate increases. However, the initial potential is hardly influenced by the amount added of sodium dichromate. Thus, it is seen that the amount added of the memory-erasing agent has a certain upper limit.

What is claimed is:

1. A process for the preparation of a photosensitive material for electrostatic photography having an improved memory resistance without substantial reduction of the initial surface potential and the dark decay residual ratio, which comprises applying to an electrically conductive substrate a coating composition prepared by adding (a) a solution of an alkali metal dichromate in a polar solvent selected from the group consisting of methanol and ethanol to (b) a composition of a finely divided photoconductive zinc oxide and an electrically insulating organic synthetic resin binder having a specific resistance of at least $10^{14}$ ohm-cm selcted from acrylic resin, polyester resin and alkyd resin in an aromatic solvent selected from the group consisting of toluene and xylene, said binder being present in an amount of 5 to 50 parts by weight per 100 parts by weight of the zinc oxide, said alkali metal dichromate being present in an amount of 0.001 to 0.01% by weight based on the zinc oxide, said coating composition being applied in a coated amount of 5 to 50 g/m$^2$, and then drying the coating composition.

2. A process according to claim 1 wherein the alkali metal dichromate is sodium dichromate.

* * * * *